US008931375B2

(12) United States Patent
Huang

(10) Patent No.: US 8,931,375 B2
(45) Date of Patent: Jan. 13, 2015

(54) RATCHET DEVICE

(71) Applicant: Chin-Tan Huang, Taichung (TW)

(72) Inventor: Chin-Tan Huang, Taichung (TW)

( * ) Notice: Subject to any disclaimer, the term of this patent is extended or adjusted under 35 U.S.C. 154(b) by 29 days.

(21) Appl. No.: 13/938,097

(22) Filed: Jul. 9, 2013

(65) Prior Publication Data

US 2014/0283654 A1 Sep. 25, 2014

(30) Foreign Application Priority Data

Mar. 20, 2013 (TW) ..... 102109850 A

(51) Int. Cl.
*B25B 13/46* (2006.01)
*B25B 15/04* (2006.01)

(52) U.S. Cl.
CPC ..... *B25B 15/04* (2013.01); *B25B 13/463* (2013.01)
USPC ..... 81/63.1; 81/63.2

(58) Field of Classification Search
USPC ..... 81/60–63.2
See application file for complete search history.

(56) References Cited

U.S. PATENT DOCUMENTS 5,582,081 A * 12/1996 Lin ..... 81/63.1
6,227,077 B1 * 5/2001 Chiang ..... 81/63.1
6,349,619 B1 * 2/2002 Liao ..... 81/62
6,450,067 B1 * 9/2002 Liao ..... 81/62
6,935,211 B2 * 8/2005 Chen ..... 81/58.4
7,028,587 B1 * 4/2006 Chiang ..... 81/63.1
7,207,243 B1 * 4/2007 Lee ..... 81/58.3
7,222,557 B2 * 5/2007 Li et al. ..... 81/63.1
7,225,708 B2 * 6/2007 Chen ..... 81/63.1
7,421,772 B2 * 9/2008 Gao et al. ..... 29/434
7,926,391 B2 * 4/2011 Hu ..... 81/63.1

FOREIGN PATENT DOCUMENTS

TW M342913 10/2008

* cited by examiner

*Primary Examiner* — Monica Carter
*Assistant Examiner* — Danny Hong
(74) *Attorney, Agent, or Firm* — DLA Piper LLP (US)

(57) ABSTRACT

A ratchet device includes a body, a ratchet wheel unit, and a switching unit. The body has an outer peripheral surface, at least one slide slot formed in the outer peripheral surface, at least one first groove, and at least one second groove. The ratchet wheel unit includes a ratchet wheel sleeved on the body, at least one first pawl member inserted into the first groove, at least one second pawl member inserted into the second groove, and resilient members biasing the first and second pawl members to engage the ratchet wheel. The switching unit is sleeved on the body, and includes a pushing member disposed in the slide slot, and a switching member connected to the pushing member. Through operation of the switching member, the first or second pawl member can be separated from the ratchet wheel.

9 Claims, 9 Drawing Sheets

RATCHET DEVICE

CROSS-REFERENCE TO RELATED APPLICATION

This application claims priority of Taiwanese Application No. 102109850, filed on Mar. 20, 2013.

BACKGROUND OF THE INVENTION

1. Field of the Invention

This invention relates to a hand tool, and more particularly to a ratchet device.

2. Description of the Related Art

Referring to FIG. 1, a conventional ratchet device disclosed in Taiwanese Patent No. M342913 includes a mounting member 1, two pawl members 2 mounted to the mounting member 1, a U-shaped resilient member 3 mounted to the mounting member 1, a direction-switching ring 4 sleeved on the mounting member 1, and a ratchet wheel 5 sleeved on the mounting member 1. The mounting member 1 has a U-shaped groove 101 for receiving the resilient member 3, and two accommodating grooves 102 located respectively at two sides of the U-shaped groove 101 for receiving the pawl members 2, respectively. The direction-switching ring 4 has an inner peripheral surface 401 and two positioning grooves 402 formed in the inner peripheral surface 401 and aligned respectively with the pawl members 2. The ratchet wheel 5 has a plurality of teeth 501. When the switching member 4 is disposed at a middle position, the pawl members 2 are biased by free ends 301 of the resilient member 3 to engage the positioning grooves 402, respectively, and engage the teeth 501 of the ratchet wheel 5. At this time, the ratchet wheel 5 can be rotated in two directions through operation of the mounting member 1.

When the switching member 4 is rotated in a direction, such that one of the pawl members 2 is pressed by the inner peripheral surface 401 to separate from the teeth 501, and the other of the pawl members 2 remains within the corresponding positioning groove 402 and engages the teeth 501, the ratchet wheel 5 is rotatable in only a single direction.

The aforesaid conventional ratchet wheel suffers from the following drawbacks:

1. Each of the pawl members 2 engages only one of the teeth 501, thereby affecting adversely transmission of power from the mounting member 1 to the ratchet wheel 5.
2. During unidirectional rotation of the ratchet wheel 5, force is transmitted from one pawl member 2 to one tooth 501. As a result, serious wear is experienced by the one pawl member 2 and the one tooth 501, thereby reducing the service life of the ratchet device.
3. When a force is applied to rotate the switching ring 4, it must be large enough to overcome the biasing force of the resilient member 3, thereby resulting in difficulties during the direction switching operation.

SUMMARY OF THE INVENTION

The object of this invention is to provide a ratchet device that can overcome the above-mentioned drawbacks associated with the prior art.

According to this invention, a ratchet device includes a body, a ratchet wheel unit, and a switching unit. The body has an outer peripheral surface, at least one slide slot formed in the outer peripheral surface, at least one first groove, and at least one second groove. The ratchet wheel unit includes a ratchet wheel sleeved on the body, at least one first pawl member inserted into the first groove, at least one second pawl member inserted into the second groove, and resilient members biasing the first and second pawl members to engage the ratchet wheel. The switching unit is sleeved on the body, and includes a pushing member disposed in the slide slot, and a switching member connected to the pushing member. Through operation of the switching member, the first or second pawl member can be separated from the ratchet wheel.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
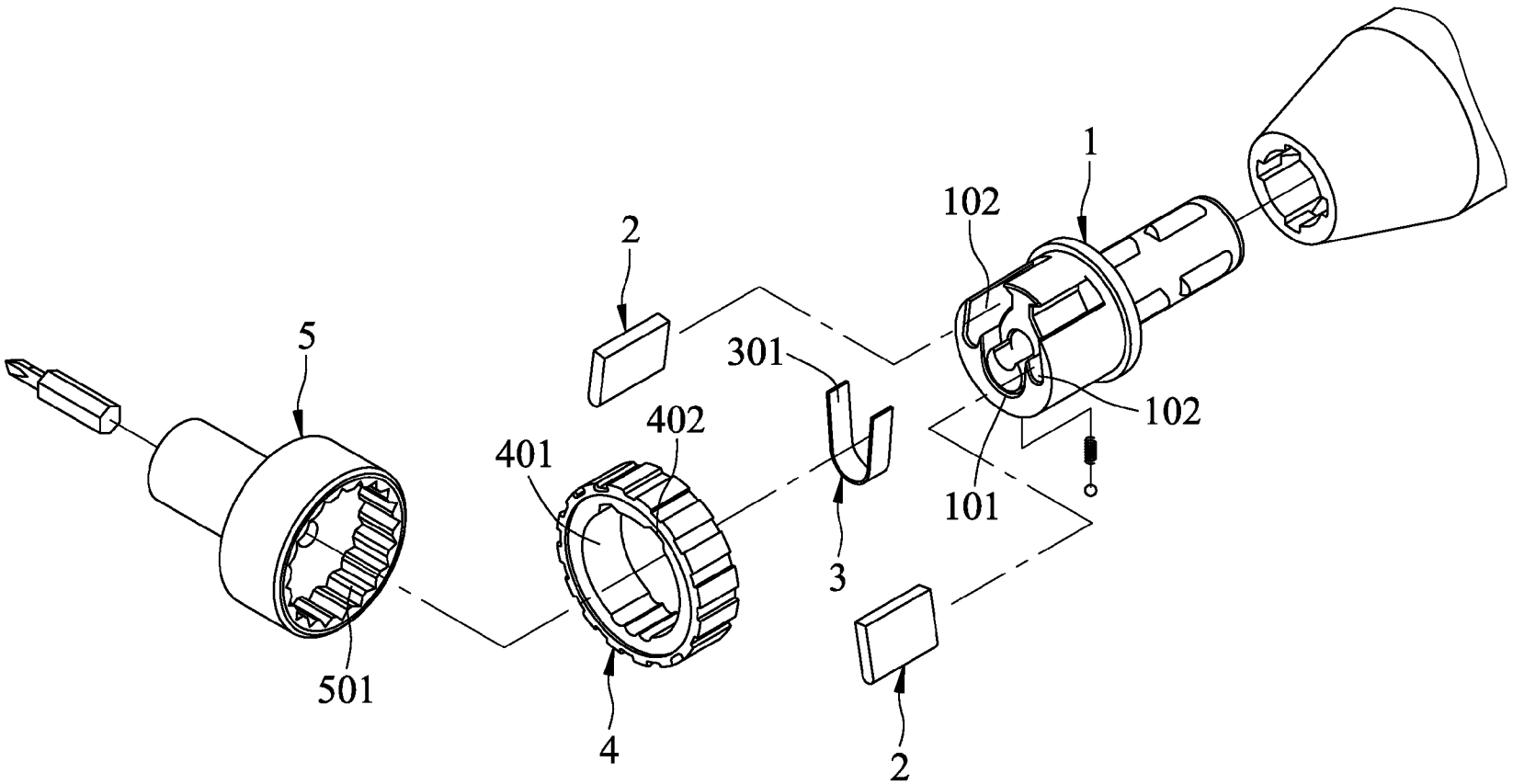
FIG.1 PRIOR ART
FIG. 1 is an exploded perspective view of a conventional ratchet device disclosed in Taiwanese Patent No. M342913.
Figure 2:
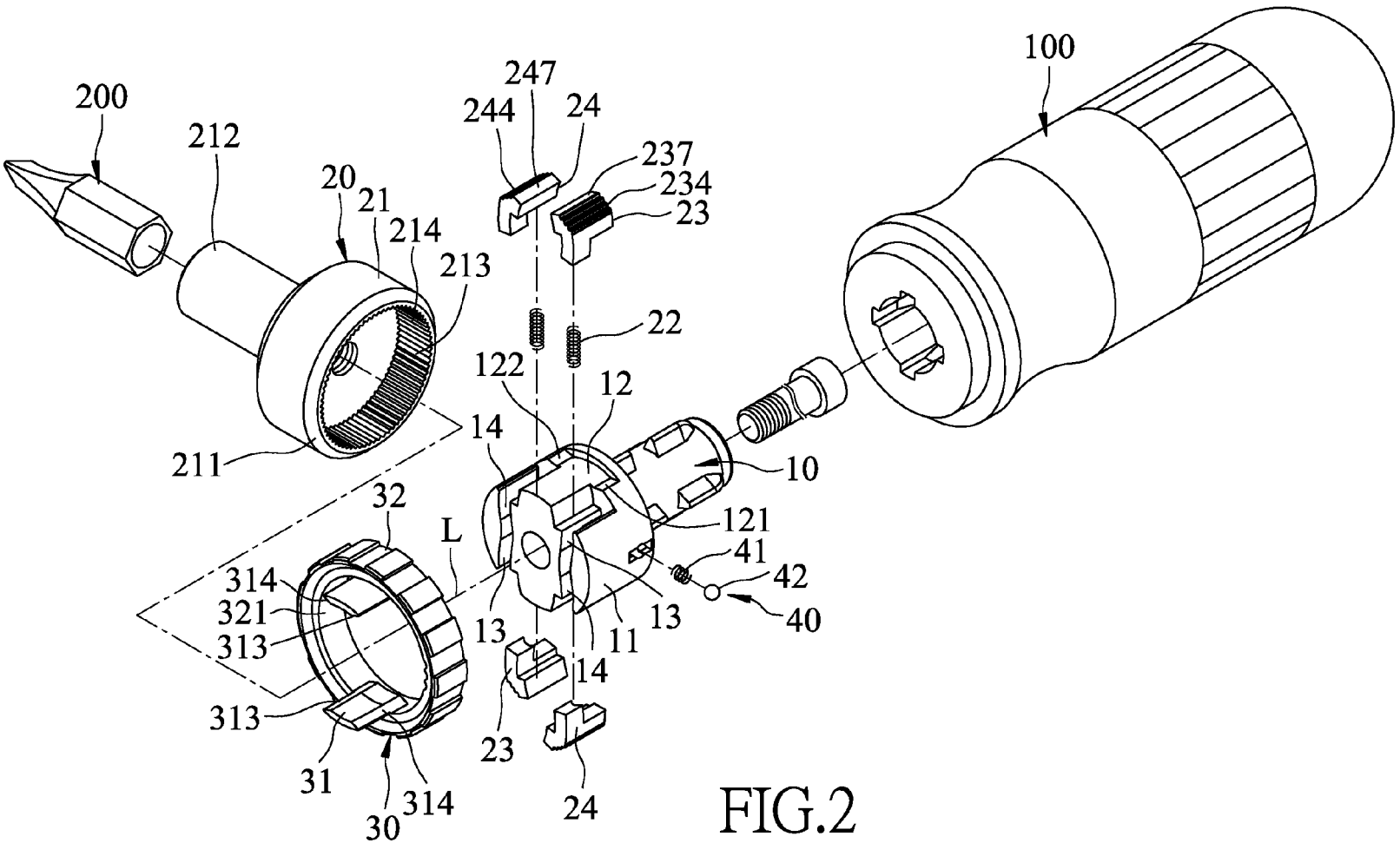
FIG. 2 is an exploded perspective view of the preferred embodiment of a ratchet device according to this invention.
Figure 3:
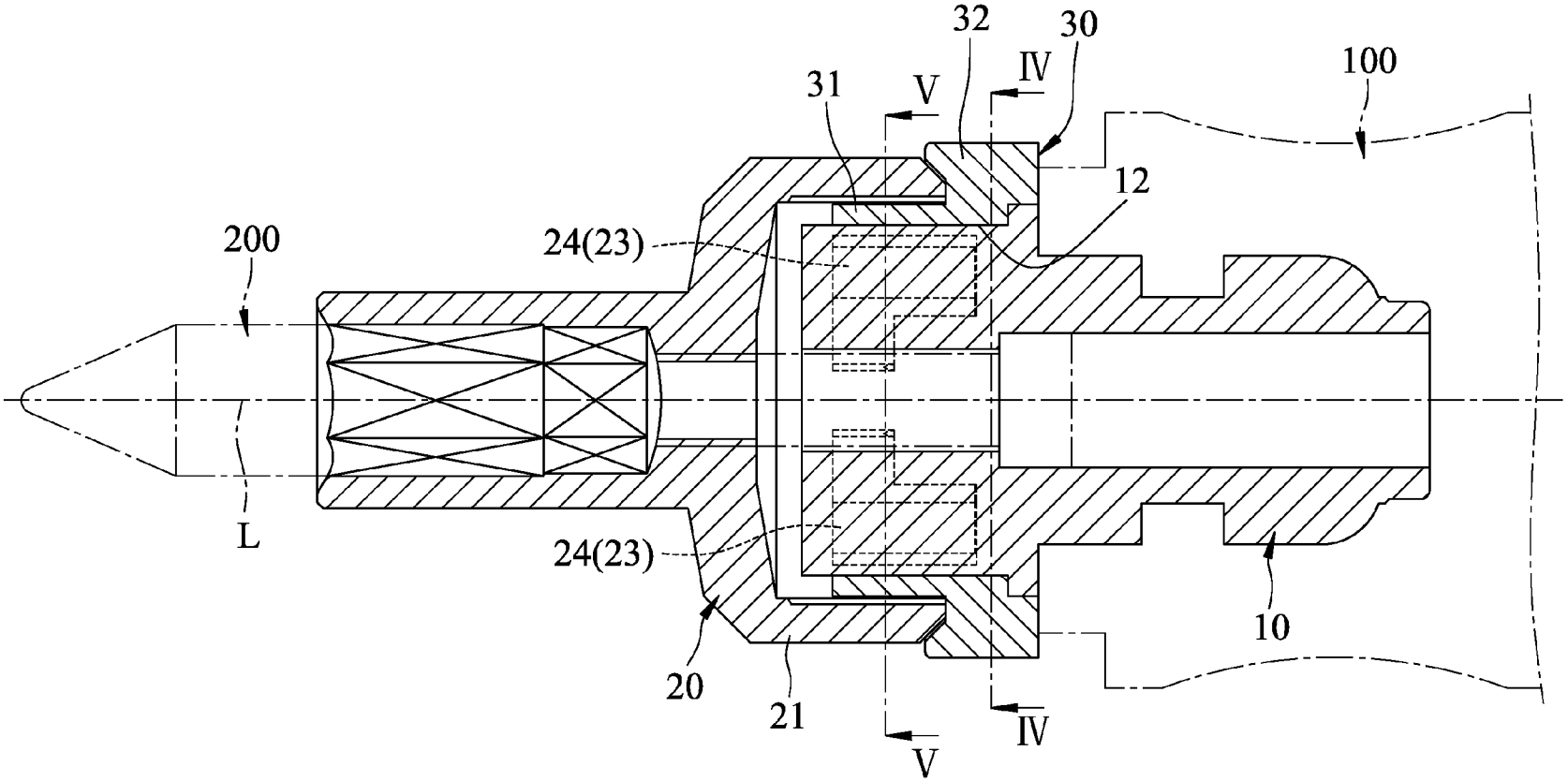
FIG. 3 is a sectional view of the preferred embodiment.

Referring to FIGS. 2 and 3, the preferred embodiment of a ratchet device according to this invention is usable with a handle 100 and a driving head 200. The ratchet device includes a cylindrical body 10, a ratchet wheel unit 20, a switching unit 30, and a positioning unit 40.

The cylindrical body 10 is connected fixedly to the handle 100, extends along an axis (L), and has an outer peripheral surface 11 disposed around the axis (L), two slide slots 12 formed in the outer peripheral surface 11, two first grooves 13 in spatial communication with and located at one side of the slide slot 12, and two second grooves 14 in spatial communication with and located at the other side of the slide slot 12. The slide slots 12 are diametrically opposite to each other. The first grooves 13 are diametrically opposite to each other. The second grooves 14 are diametrically opposite to each other. In this embodiment, one of the first grooves 13 is in spatial communication with one of the second grooves 14, and the other of the first grooves 13 is in spatial communication with the other of the second grooves 14.

Figure 4:
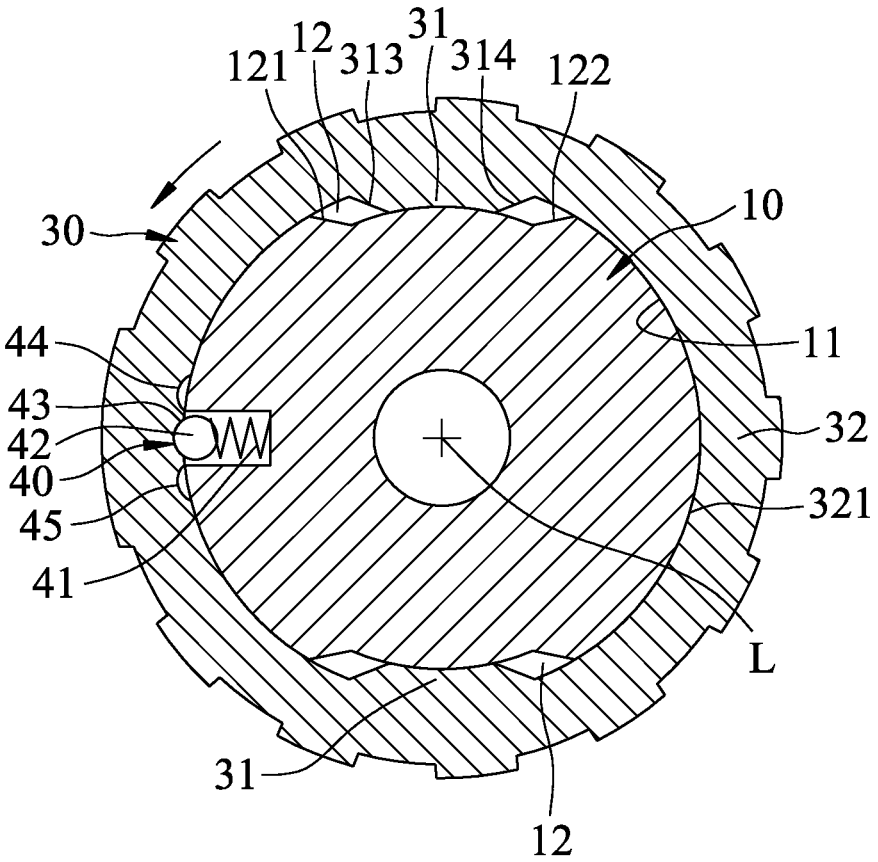
FIG. 4 is a sectional view taken along line IV-IV in FIG. 3, illustrating a connection between a body and a switching unit.
Figure 5:
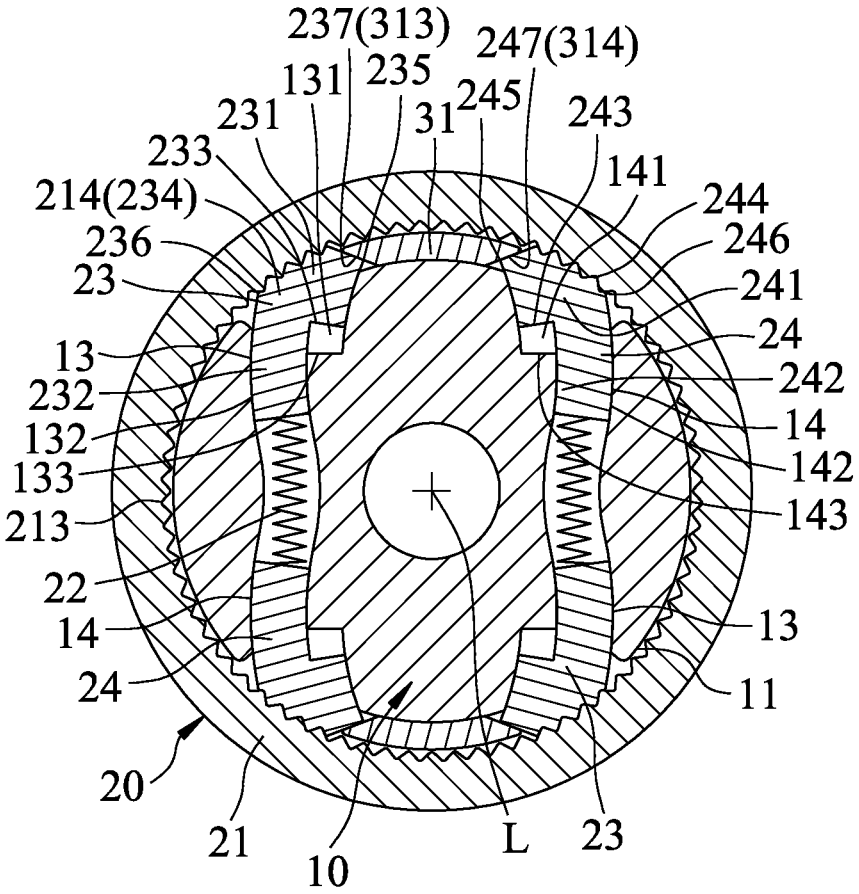
FIG. 5 is a sectional view taken along line V-V in FIG. 3, illustrating a connection between the body and a ratchet wheel unit.

With further reference to FIGS. 4 and 5, each of the slide slots 12 is defined by an inclined first positioning surface 121 and an inclined second positioning surface 122. The first and second positioning surfaces 121, 122 are inclined with respect to the axis (L).

With particular reference to FIG. 5, each of the first grooves 13 is L-shaped, and has a first outer groove section 131 proximate to the corresponding slide slot 12, and a first inner groove section 132 distal from the corresponding slide slot 12. The first outer groove section 131 has a side proximate to the first inner groove section 132 and defined by a first shoulder surface 133. Each of the second grooves 14 is L-shaped, and has a second outer groove section 141 proximate to the corresponding slide slot 12, and a second inner groove section 142 distal from the corresponding slide slot 12. The second outer groove section 141 has aside proximate to the second inner groove section 132 and defined by a second shoulder surface 143. Each of the first and second outer groove sections 131, 141 and the first and second inner groove sections 132, 142 is curved.

The ratchet wheel unit 20 includes a ratchet wheel 21 sleeved on the body 10, two first pawl members 23 inserted respectively into the first grooves 13, two second pawl members 24 inserted respectively into the second grooves 14, and two resilient members 22 each disposed in a respective one of the first grooves 13 and a respective one of the second grooves 14.

The ratchet wheel 21 has a sleeve end 211 and a work end 212 opposite to the sleeve end 211 and permitting the driving head 200 to be inserted therein. The sleeve end 211 has an inner peripheral surface 213 disposed around and adjacent to the outer peripheral surface 11, and a plurality of ratchet teeth 214 formed on the inner peripheral surface 213.

Each of the first pawl members 23 is L-shaped, and has a first toothed end 231 proximate to the corresponding slide slot 12, a first non-toothed end 232 distal from the corresponding slide slot 12 and opposite to the first toothed end 231, a first stop surface 233 contactable with the first shoulder surface 133, and a plurality of first pawl teeth 234 formed in an end surface of the first toothed end 231 and engageable with the ratchet teeth 214. The first toothed end 231 has a first inner side edge 235 proximate to the corresponding slide slot 12, a first outer side edge 236 distal from the corresponding slide slot 12, and an inclined first guiding surface 237 disposed at the first inner side edge 235, such that the first pawl teeth 234 are disposed between the first outer side edge 236 and the first guiding surface 237. Interengaging surfaces of each of the first pawls 23 and a wall defining a corresponding one of the first grooves 13 are curved.

Each of the second pawl members 24 is L-shaped, and has a second toothed end 241 proximate to the corresponding slide slot 12, a second non-toothed end 242 distal from the corresponding slide slot 12 and opposite to the second toothed end 241, a second stop surface 243 contactable with the second shoulder surface 143, and a plurality of second pawl teeth 244 formed in an end surface of the second toothed end 241 and engageable with the ratchet teeth 214. The second toothed end 241 has a second inner side edge 245 proximate to the corresponding slide slot 12, a second outer side edge 246 distal from the corresponding slide slot 12, and an inclined second guiding surface 247 disposed at the second inner side edge 245, such that the second pawl teeth 244 are disposed between the second outer side edge 246 and the second guiding surface 247. Interengaging surfaces of each of the second pawls 24 and a wall defining a corresponding one of the second grooves 14 is curved.

Each of the resilient members 22 abuts against the non-toothed end 232 of the corresponding first pawl member 23 and the non-toothed end 242 of the corresponding second pawl member 24 for biasing the first and second pawl members 23, 24 toward the ratchet teeth 214.

The switching unit 30 is sleeved on the body 10, and includes two pushing members 31 rotatable about the axis (L) in the slide slots 12, respectively, and a switching member 32 interconnecting the pushing members 31. The switching member 32 is annular, is sleeved rotatably on the body 10, and has an inner peripheral surface 321. The pushing members 31 are diametrically opposite to each other, and are connected fixedly to the inner peripheral surface 321. Each of the pushing members 31 has an inclined first pressing surface 313 aligned with and movable toward or away from the corresponding first pawl member 23, and an inclined second pressing surface 314 aligned with and movable toward or away from the corresponding second pawl member 24. The first and second pressing surfaces 313, 314 are inclined with respect to the axis (L), and are movable to contact the first and second positioning surfaces 121, 122.

The positioning unit 40 includes a spring 41 disposed in the body 10, a ball 42 biased by the spring 41 to project outwardly from the outer peripheral surface 11, a middle cavity 43 formed in the inner peripheral surface 321, a first cavity 44 formed in the inner peripheral surface 321 and located at one side of the middle cavity 43, and a second cavity 45 formed in the inner peripheral surface 321 and located at the other side of the middle cavity 43.

With particular reference to FIGS. 3, 4, and 5, when the switching member 32 is rotated to engage the ball 42 of the positioning unit 40 within the middle cavity 43, each of the pushing members 31 is disposed in a middle portion of the corresponding slide slot 12 such that it is not in contact with the first and second positioning surfaces 121, 122 of the corresponding slide slot 12. At this time, the first and second pawl teeth 234, 244 are biased by the resilient members 22 to mesh with the ratchet teeth 214, so that the handle 100 can be operated to rotate the ratchet wheel 21 and the driving head 200 clockwise or counterclockwise.

Figure 6:
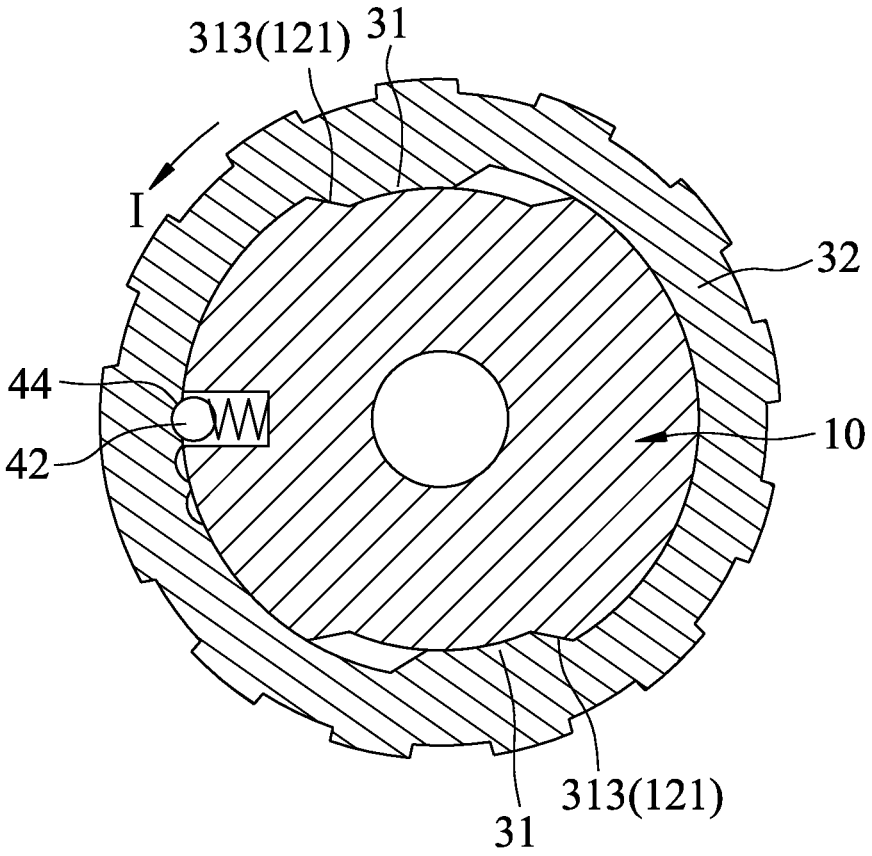
FIG. 6 is a view similar to FIG. 4 but illustrating that a switching member of the switching unit is rotated in a first direction.
Figure 7:
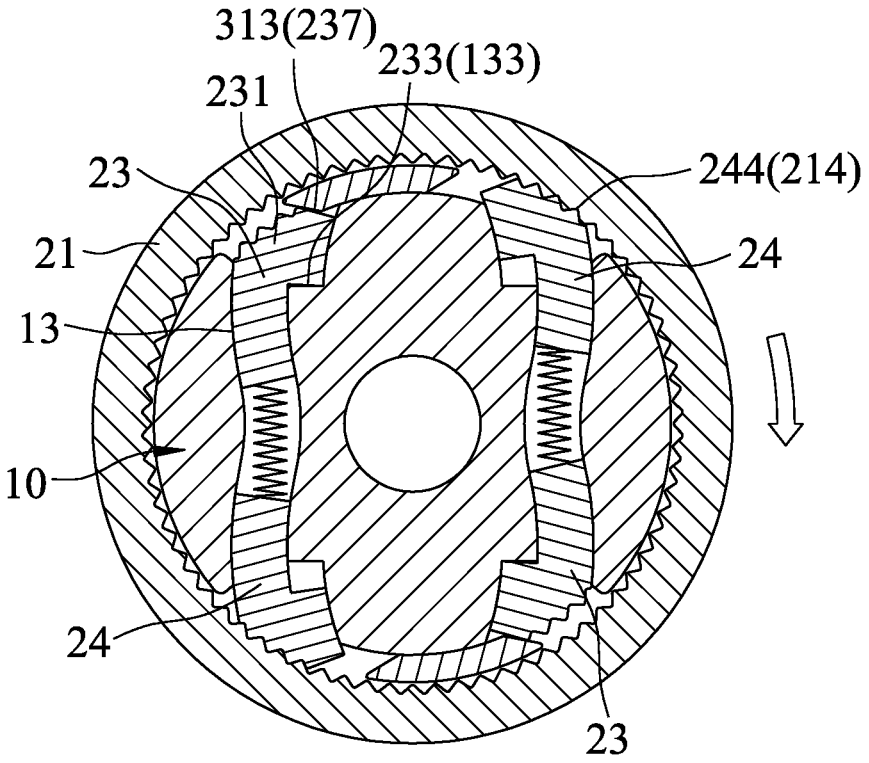
FIG. 7 is a view similar to FIG. 5 but illustrating that a first pawl member is pressed by a pushing member of the switching unit to allow for unidirectional rotation of the ratchet wheel unit.

With particular reference to FIGS. 3, 6, and 7, when the switching member 32 is rotated relative to the body 10 in a first direction (I) (see FIG. 6), the ball 42 is engaged into the first cavity 44. At the same time, the first pressing surfaces 313 slide on the first positioning surfaces 121, respectively, so that the first pawl members 23 are pressed by the pushing members 31 to separate from the ratchet teeth 214. Hence, since only the second pawl teeth 244 mesh with the ratchet teeth 214, when the body 10 is rotated clockwise, the second pawl members 24 can rotate the ratchet wheel 21, and when the body 10 is rotated counterclockwise, the second pawl members 24 cannot rotate the ratchet wheel 21.

Figure 8:
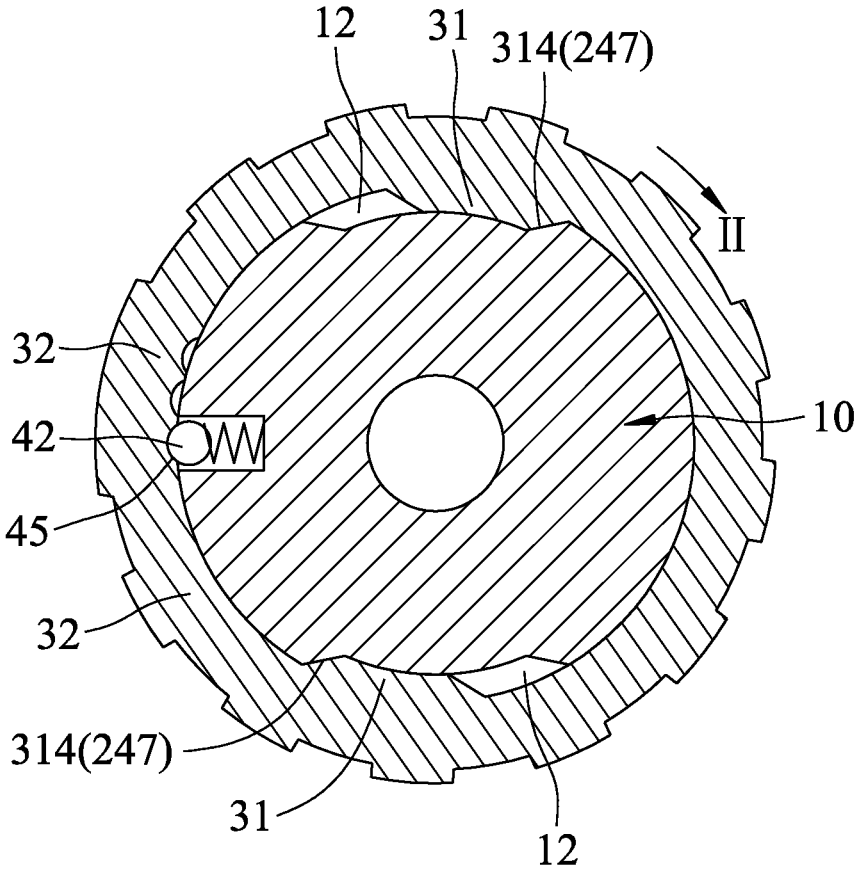
FIG. 8 is a view similar to FIG. 4 but illustrating that the switching member is rotated in a second direction.
Figure 9:
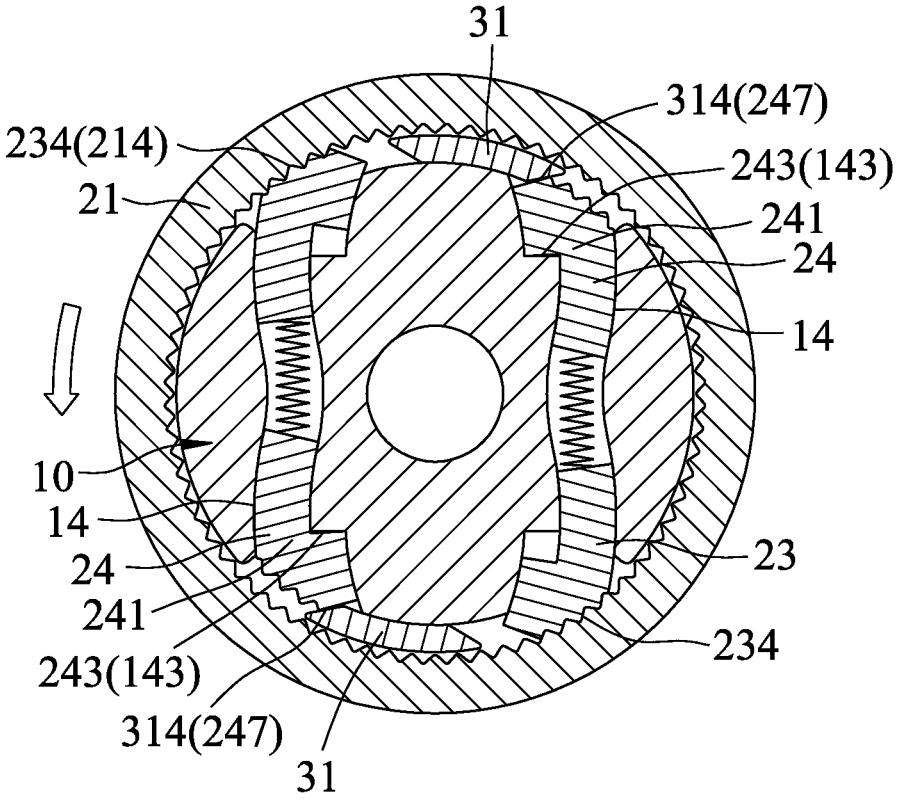
FIG. 9 is a view similar to FIG. 5 but illustrating that a second pawl member is pressed by the pushing member to allow for unidirectional rotation of the ratchet wheel.

With particular reference to FIGS. 8 and 9, when the switching member 32 is rotated relative to the body 10 in a second direction (II) (see FIG. 8), the ball 42 is engaged into the second cavity 45. At the same time, the second pressing surfaces 314 slide on the second positioning surfaces 122, respectively, so that the second pawl members 24 are pressed by the pushing members 31 to separate from the ratchet teeth 214. Hence, since only the first pawl teeth 234 mesh with the ratchet teeth 214, when the body 10 is rotated counterclockwise, the first pawl members 23 can rotate the ratchet wheel 21, and when the body 10 is rotated clockwise, the first pawl members 23 cannot rotate the ratchet wheel 21.

When the rotational direction of the ratchet wheel 21 is switched, since the interengaging surfaces between the first pawl members 23 and walls defining the first grooves 13 and between the second pawl members 24 and walls defining the second grooves 14 are curved, smooth movement of the first and second pawl members 23, 24 can be ensured.

In view of the above, the ratchet device of this invention has the following advantages:

1. Each of the first and second pawl members 23, 24 has a plurality of pawl teeth 234, 244 for engaging the ratchet teeth 214, so as to increase contact area therebetween, thereby facilitating transmission of power from the body 10 to the ratchet wheel 21.
2. During unidirectional rotation of the ratchet wheel 21, force is transmitted from one body 10 to the pawl teeth 234, 244 of two first or second pawl members 23, 24. Consequently, wear experienced by the ratchet teeth 214 and the first and second pawl members 23, 24 is reduced significantly, thus prolonging the service life of the ratchet device.
3. When a force is applied to rotate the switching member 32, the pushing members 31 are moved within the slide slots 12, respectively, in such a manner that the first and second pressing surfaces 313, 314 move respectively on the first and second guiding surfaces 237, 247. In this manner, the biasing force of the resilient members 22 can be overcome with relative ease to press the first or second pawls members 23, 24. As a consequence, the ratchet device is easy to operate.

It should be noted that, the ratchet wheel unit 20 may includes four resilient members 22 for biasing the first and second pawl members 23, 24. If this occurs, there is no need for the first grooves 13 to be in spatial communication with the second grooves 14, respectively.

With this invention thus explained, it is apparent that numerous modifications and variations can be made without departing from the scope and spirit of this invention. It is therefore intended that this invention be limited only as indicated by the appended claims.

I claim:

1. A ratchet device comprising:

a body extending along an axis and having an outer peripheral surface disposed around the axis, at least one slide slot formed in said outer peripheral surface, at least one first groove in spatial communication with and located at one side of said slide slot, and at least one second insert groove in spatial communication with and located at the other side of said slide slot;

a ratchet wheel unit including a ratchet wheel sleeved on said body, at least one first pawl member inserted into said first groove, at least one second pawl member inserted into said second groove, and a pair of resilient members disposed respectively within said first and second grooves, said ratchet wheel having a sleeve end sleeved on said body, and a work end opposite to said sleeve end, said sleeve end having an annular inner peripheral surface and a plurality of ratchet teeth disposed on said inner peripheral surface, said first pawl member having a plurality of first pawl teeth engageable with said ratchet teeth, said second pawl member having a plurality of second pawl teeth engageable with said ratchet teeth, said resilient members biasing said first and second pawl members toward said ratchet teeth; and a switching unit sleeved on said body and including a pushing member rotatable about the axis in said slide slot, and a switching member connected to said pushing member, said switching member being operable to rotate said pushing member in said slide slot so as to retract a selected one said first and second pawl members into a corresponding one of said first and second grooves.

2. The ratchet device as claimed in claim 1, wherein said first pawl member has a first toothed end proximate to said slide slot, and a first non-toothed end distal from said slide slot and opposite to said first toothed end, said first toothed end having a first inner side edge proximate to said slide slot, a first outer side edge distal from said slide slot, and an inclined first guiding surface disposed at said first inner side edge, said first pawl teeth being disposed between said first outer side edge and said inclined first guiding surface, said second pawl member having a second toothed end proximate to said slide slot, and a second non-toothed end distal from said slide slot and opposite to said second toothed end, said second toothed end having a second inner side edge proximate to said slide slot, a second outer side edge distal from said slide slot, and an inclined second guiding surface disposed at said second inner side edge.

3. The ratchet device as claimed in claim 2, wherein said pushing member of said switching unit has an inclined first pressing surface aligned with and movable toward or away from said first pawl member, and an inclined second pressing surface aligned with and movable toward or away from said second pawl member, said first and second pressing surfaces being inclined with respect to the axis.

4. The ratchet device as claimed in claim 3, wherein said switching member of said switching unit is annular, and has an inner peripheral surface disposed around and adjacent to said outer peripheral surface, said ratchet device further comprises a positioning unit, said positioning unit including a spring disposed in said body, a ball biased by said spring to project outwardly from said outer peripheral surface, a middle cavity formed in said inner peripheral surface of said switching member, a first cavity formed in said inner peripheral surface of said switching member and located at one side of said middle cavity, and a second cavity formed in said inner peripheral surface of said switching member and located at the other side of said middle cavity such that, when said ball engages said middle cavity, said pushing member is disposed in a middle portion of said slide slot, and said first and second pawl teeth mesh with said ratchet teeth, when said ball engages said first cavity, said first pawl member is pressed by said pushing member to separate from said ratchet teeth, and said second pawl member engages said ratchet teeth, and when said ball engages said second cavity, said second pawl member is pressed by said pushing member to separate from said ratchet teeth, and said first pawl member engages said ratchet teeth.

5. The ratchet device as claimed in claim 4, wherein said body is cylindrical, and includes two said slide slots, two said first grooves, and two said second grooves, said slide slots being diametrically opposite to each other, said first grooves being diametrically opposite to each other, said second grooves being diametrically to each other.

6. The ratchet device as claimed in claim 5, wherein one of said first grooves is in spatial communication with one of said second grooves, and the other of said first grooves is in spatial communication with the other of said second grooves, said ratchet wheel unit including two said resilient members each disposed between and abutting against a respective one of said first pawl members and a respective one of said second pawl members.

7. The ratchet device as claimed in claim 6, wherein:

each of said first grooves is L-shaped, and has a first outer groove section corresponding to said first toothed end, and a first inner groove section perpendicular to said first outer groove section and corresponding to said first non-toothed end, said first outer groove section having a side that is proximate to said first inner groove section and that is defined by a first shoulder surface;

each of said second grooves is L-shaped, and has a second outer groove section corresponding to said second toothed end, and a second inner groove section perpendicular to said second outer groove section and corresponding to said second non-toothed end, said second outer groove section having a side that is proximate to said second inner groove section and that is defined by a second shoulder surface;

each of said first pawl members is L-shaped, and has a first toothed end proximate to a corresponding one of said slide slots, a first non-toothed end distal from the corresponding one of said slide slots and opposite to the first toothed end, and a first stop surface that is moved to contact said first shoulder surface when a corresponding one of said first pawl members is retracted into a corresponding one of said first grooves; and each of said second pawl members is L-shaped, and has a second toothed end proximate to a corresponding one of said slide slots, a second non-toothed end distal from the corresponding one of said slide slots and opposite to the second toothed end, and a second stop surface that is moved to contact said second shoulder surface when a corresponding one of said second pawl members is retracted into a corresponding one of said second grooves.

8. The ratchet device as claimed in claim 7, wherein:

each of said first and second inner and outer groove sections of said first and second grooves is curved;

interengaging surfaces of each of said first pawls and a wall defining a corresponding one of said first grooves are curved; and interengaging surfaces of each of said second pawls and a wall defining a corresponding one of said second grooves is curved.

9. The ratchet device as claimed in claim 3, wherein said body has inclined first and second positioning surfaces defining respectively two opposite ends of said slide slot, said first and second positioning surfaces being inclined with respect to the axis and being contactable respectively with said first and second pressing surfaces of said pushing member such that, when said first pressing surface is in contact with said first positioning surface, said first pawl member is retracted into said first groove, and when said second pressing surface is in contact with said second positioning surface, said second pawl member is retracted into said second groove.

* * * * *